US008590876B1

(12) United States Patent
Madson

(10) Patent No.: US 8,590,876 B1
(45) Date of Patent: Nov. 26, 2013

(54) OBJECT SECURING APPARATUS

(76) Inventor: Dane Curtis Madson, Longview, TX (US)

( * ) Notice: Subject to any disclaimer, the term of this patent is extended or adjusted under 35 U.S.C. 154(b) by 440 days.

(21) Appl. No.: 12/968,888

(22) Filed: Dec. 15, 2010

Related U.S. Application Data

(60) Provisional application No. 61/286,956, filed on Dec. 16, 2009.

(51) Int. Cl.
*B25B 1/22* (2006.01)

(52) U.S. Cl.
USPC ..... 269/130; 254/2 B; 254/134

(58) Field of Classification Search
USPC ..... 269/130, 131, 43; 254/2 B, 133 R, 134, 254/100, 103
See application file for complete search history.

(56) References Cited

U.S. PATENT DOCUMENTS

| | | | | | |
|---|---|---|---|---|---|
| 1,410,553 | A * | 3/1922 | Cox | 269/130 |
| 1,657,781 | A * | 1/1928 | Brown | 254/100 |
| 2,455,517 | A * | 12/1948 | Nielson | 269/130 |
| 3,805,646 | A * | 4/1974 | Knight | 81/69 |
| 3,856,050 | A | 12/1974 | Rooney | |
| 3,901,476 | A | 8/1975 | Giampaglia | |
| 3,946,988 | A * | 3/1976 | Kehren | 254/30 |
| 6,073,919 | A | 6/2000 | Hammit et al. | |
| 6,089,554 | A * | 7/2000 | Berardino | 269/130 |
| 6,705,596 | B2 * | 3/2004 | Reinikka et al. | 254/134 |
| 8,162,289 | B2 * | 4/2012 | McCaleb | 254/98 |
| 8,297,605 | B2 * | 10/2012 | Lee et al. | 269/75 |

FOREIGN PATENT DOCUMENTS

| | | | |
|---|---|---|---|
| JP | 2003-097787 | A | 4/2003 |
| JP | 2007-315586 | A | 12/2007 |
| KR | 20-0266828 | Y1 | 3/2002 |
| KR | 10-0517382 | B1 | 9/2005 |
| WO | 98-30829 | A1 | 7/1998 |

* cited by examiner

*Primary Examiner* — Lee D Wilson
(74) *Attorney, Agent, or Firm* — Egbert Law Offices, PLLC

(57) ABSTRACT

An apparatus for securing objects has an outer housing, a stand positioned within the outer housing, a jaw affixed to an upper end of the stand and having a surface on a top thereof suitable for receiving the object thereon, a latching member coupled to the outer housing, and a mechanism for selectively moving the jaw in relative to the latching member. The latching member is extendable over the top of the jaw. The latching member is suitable for securely retaining the object against the top of the jaw. Either the jaw can be moved upwardly or the latching member can be moved downwardly so as to fix the object therebetween.

18 Claims, 6 Drawing Sheets

OBJECT SECURING APPARATUS

CROSS-REFERENCE TO RELATED APPLICATIONS

The present application claims priority from U.S. Provisional Patent Application No. 61/286,956, filed on Dec. 16, 2009, and entitled "Tool for Securing Objects".

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to apparatus that are used to fixedly secure an object thereto, in a nature of a vise. More particularly, the present invention relates to bottle jacks, to chain vises, and to pipe benders.

2. Description of Related Art

Including Information Disclosed Under 37 CFR 1.97 and 37 CFR 1.98.

A vise is generally a mechanical apparatus used for holding or clamping a workpiece or other objects to facilitate work to be performed on the workpiece or other object with tools such as pipe wrenches, saws, planes, drills, mills, screwdrivers, sandpaper, etc. The workpiece, while held in the vise, may be cut, threaded and so on. A vise (i.e., a workholding device) is an assembly with one fixed jaw and one moveable jaw, or a jaw and a latching member, and so on, and is often used to hold simple rectangular, cubic, or cylindrical workpieces on a mill or machining center. For a vise having one jaw and a latching member, the object or workpiece is typically encircled by the latching member and held tightly between the jaw and the latching member.

A conventional chain vise has a base, a V-shaped jaw projected upwardly at one end from the base, and a V-shaped support projecting upwardly at the other end of the base so that a segment a pipe or similar material resting in the jaw and in the support is in a condition of stable equilibrium. A chain is anchored to the base in the vicinity of the jaw and can be wrapped over the pipe. The chain is provided with a tightening mechanism for tightening the chain over the pipe and holding the pipe against the jaw. In this way, the pipe is held securely in the chain vise.

A screw jack is a device used to fully or partially lift an object off the ground. Depending on their size, these devices can be used to raise the corner of a vehicle, or to lift it several feet in the air so workers can access the bottom of the vehicle. Screw jacks are often found in machine shops, auto repair facilities and in the automotive racing industry. Many vehicles also have a screw jack included with the spare tire kit, so drivers can repair a flat tire more easily. Very large screw jack systems are even used to lift houses for foundation repair or replacement.

A bottle jack is a hydraulic jack that can be placed in a horizontal position. These jacks push against a lever, which lifts the main lift arm. Bottle jacks have a longer handle than most hydraulic jacks, however, and it is possible to get more lift per stroke with the increased leverage they provide when compared to regular models of jacks. Bottle jacks are versatile because their horizontal position makes it possible to place them in tight spots and to provide good leverage.

Various patents have issued relating to chain vises. In particular, U.S. Pat. No. 3,901,476, issued on Aug. 26, 1975 to A. R. Giampaglia, shows a chain vise in which a first pair of jaws is rigidly attached to a support and a second pair of jaws is pivotably attached to the support. A threaded shaft rotatably attached to the first pair of jaws is engaged with a threaded block in a second pair of jaws. When the shaft is rotated by a crank, it draws the pivotable second pair of jaws toward or away from the first pair of jaws. The shaft and crank maintain a fixed relation to the first pair of jaws which are rigidly attached to the support.

U.S. Pat. No. 6,073,919, issued on Jun. 13, 2000 to Hammit et al., describes a stand for chain vise. This support structure for a chain vise has portions for engaging a support surface and includes a mechanism for tilting the chain vise relative to the support surface. The chain vise includes a jaw with a chain extending thereover. A mechanical wheel is utilized so as to draw the ends of the chain downwardly so as to be in compressive contact with the object.

It is an object of the present invention to provide an apparatus that operates as a three-in-one tool that includes a chain vise, a bottle jack and a pipe bender.

It is another object of the present invention to provide an apparatus that effectively distributes forces evenly over the secured object.

It is another object of the present invention to provide an apparatus that avoids single contact forces.

It is another object of the present invention to provide an apparatus for securing objects that has a lower failure rate than existing vises.

It is another object of the present invention to provide an apparatus for securing objects that has a long life expectancy.

It is still another object of the present invention to provide an apparatus for securing objects that has a very small storage volume.

It is still a further object of the present invention to provide an apparatus for securing objects that has reduced scaring, marring, damage or shape alteration.

It is still a further object of the present invention to provide an apparatus for securing objects that is adapted to a wide variety of fields of use.

It is still another object of the present invention to provide an apparatus for securing objects that can be mountable on exterior surfaces, such as work benches or service vehicles.

It is still another object of the present invention to provide an apparatus for securing objects that can be used with a wide variety of shapes and sizes of objects.

These and other objects and advantages of the present invention will become apparent from a reading of the attached specification and appended claims.

BRIEF SUMMARY OF THE INVENTION

The present invention is an apparatus for securing an object that comprises an outer housing, a stand positioned within the outer housing, a jaw affixed to an upper end of the stand, a latching member coupled to the outer housing, and a means for selectively moving the jaw in relative to the latching member. The jaw has a surface on a top thereof suitable for receiving the object thereon. The latching member is extendable over the top of the jaw. The latching member suitable for securely retaining the object against the top of the jaw.

In the preferred embodiment of the present invention, there is a base affixed to a bottom of the stand. The base will have a diameter greater than a diameter of the stand. The base has a plurality of fasteners secured thereto so as to allow the base to be affixed upon an underlying surface.

The stand is in the form of a cylindrical member extending vertically upwardly. The outer housing has an interior passageway receiving the stand therein. The stand also has a threaded portion. The means for selectively moving includes a coupler member threadedly engaged with the threaded portion of the stand. The coupler member is connected to the outer housing so as to move the outer housing vertically relative to a rotational movement of the coupler member about the threaded portion. The coupler member has an arm extending outwardly therefrom.

The stand has a splined surface at an upper end thereof. The jaw has splines on a surface thereof opposite the top thereof. The splines of the jaw selectively engage the splined surface of the stand. The latching member has one end fixedly mounted to one side of the outer housing and an opposite end releaseably connected to an opposite side of the outer housing.

The latching member is in the form of a chain having a plurality of links. One of the plurality of links engaged by a pin within a mounting wing on the one side of the outer housing. The outer housing has a latch extending outwardly of the opposite side of the housing. Another of the plurality of links is secured to the latch.

In the preferred embodiment of the present invention, the jaw has a V-shape. In particular, the size of this V-shape will have a textured surface, such as teeth.

In an alternative embodiment of the present invention, the stand has a threaded portion extending therearound. The outer housing has a threaded area threadedly engaged with the threaded portion of the stand. The means for selectively moving includes a pin engaged with the stand so as to rotate the stand in relation to the outer housing so as to raise and lower the jaw. The outer housing has an inner wall defining an inner passageway. The inner wall has splines extending inwardly therefrom. The jaw has an annular portion extending downwardly therefrom. The annular portion has a splined area selectively received by the splines of the outer housing. The stand extends into the annular portion so as to abut a bottom of the jaw. A base is formed at an bottom of the outer housing. This base has an outer diameter greater than an outer diameter of the outer housing.

In another alternative embodiment of the present invention, the stand has a thread formed around an outer surface thereof. The outer housing has an annular member extending around an upper portion of the stand. This annular member has a channel formed therein. The means for selectively moving includes a coupler having an internal thread engaged with the thread of the stand. The coupler has a pin engaged with the channel on the outer housing. The coupler is rotatable about the stand so as to cause the pin to raise or lower the outer housing. The coupler has an arm extending outwardly therefrom. In this embodiment of the present invention, the jaw is integrally formed at a top of the stand.

In still a further embodiment of the present invention, the means for selectively moving is a bottle jack. This bottle jack is hydraulically cooperative with the stand so as to move the stand vertically relative to the outer housing.

In the present invention, a bending plate can be received on the top surface of the jaw. This bending plate is suitable for receiving the object thereon. The latching member has a die extending inwardly therefrom. In one embodiment of the jaws of the present invention, the jaw will have a first V-shaped toothed portion, a second V-shaped toothed portion, and an untoothed portion positioned between the first and second V-shaped toothed portions.

The various embodiments of the present invention generally distribute the force substantially even across the latching member. As a result, there is typically no single contact point of the latching member that receives a greater percentage of exerted force. This reduces the chance of latching member failure (e.g. breakage) and extends the life of the latching member. In terms of movement, certain embodiments of the apparatus of the present invention pull down the latching member while others push up the jaw. It should be emphasized that the apparatus of the various embodiments of the present invention are beneficially relatively simple to those known latching vises. For example, one form of the present invention is very simplified and serves to push up the jaw in order to engage the latching member. Certain other embodiments of the present invention offer a 360° rotation of the jaw and latching member assembly. This can be beneficial, for example, while working in confined spaces or where the object secured is irregularly shaped or has several bends. Nevertheless, in operation, generally all of the embodiments of the present invention can be used to securely hold an object, such as pipe. In certain of the embodiments, a removable mounting base plate can be utilized. In all of the embodiments, the apparatus can be considered as a multipurpose tool having far more functions than that of a typical vise.

When the apparatus for the present invention is engaged with an object, the pressurized latching member force is substantially equalized between the latching member mount wing and the opposing latching member latch wing so as to eliminate or significantly reduce all engagement forces that are provided by a singular point pressurization, as with the prior art. This prolongs the service life, and reduces dangerous and costly breakages. It also creates consistent, compounded force leverage of the secured object over the entire contact surface area of the latching member, the jaw base and the outer circumference the object. This equalized hydraulic force creates a relatively strong grasping with the latching member.

The present invention avoids these problems of the prior art. The enlarged V-shaped jaw base performs a protective coverage feature to the upper jaw base seal and the external surface area of the jaw base cylinder, when in the retracted operational position. This keeps the debris and foreign corrosive fluids from entering between the seal surface area and the jaw base. In other words, the jaw of the present invention provides umbrella-type of corrosion and debris protection of the apparatus. As such, the present invention able to achieve significant benefits over that of the prior art.

DETAILED DESCRIPTION OF THE INVENTION

Figure 1:
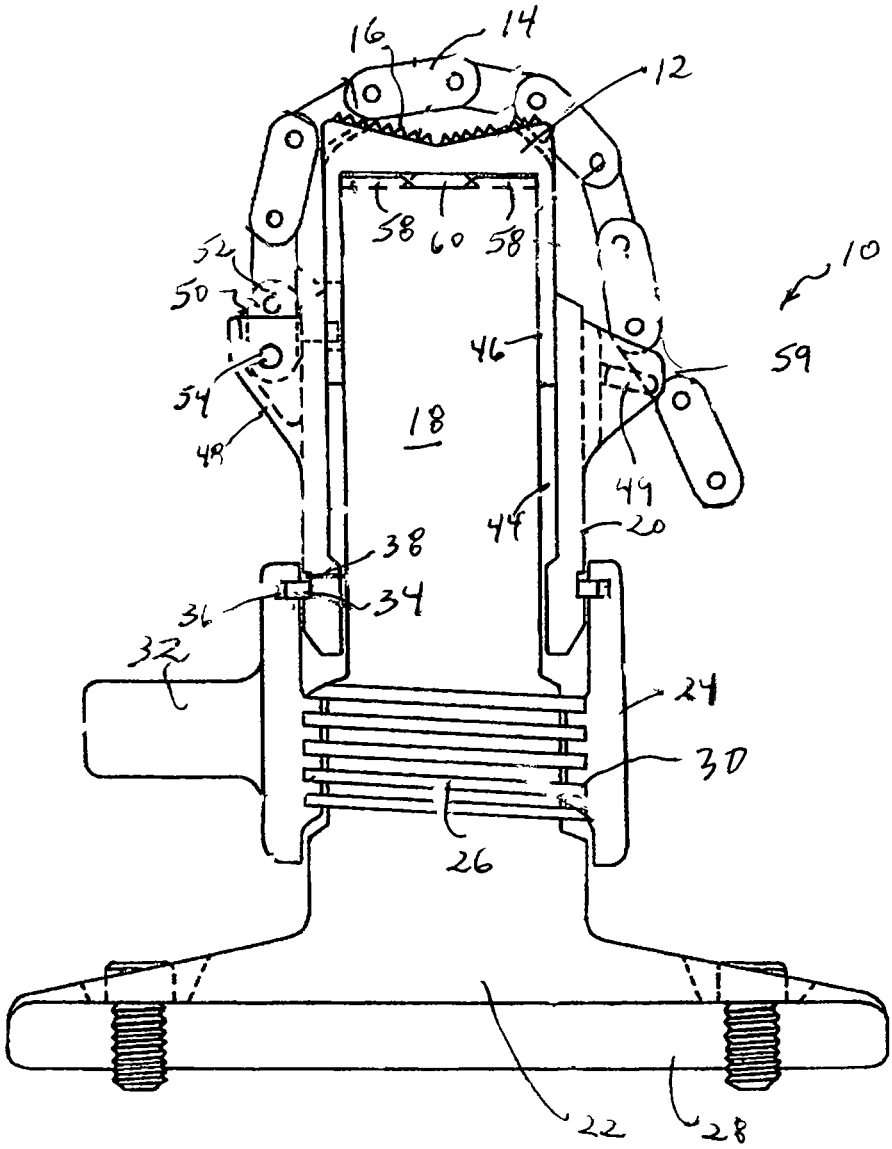
FIG. 1 is a cross-section showing the apparatus for securing objects in accordance with the preferred embodiment of the present invention.

Referring to FIG. 1, there is shown the apparatus 10 for securing objects in accordance with the preferred embodiment of the present invention. The apparatus 10 can be used for securing objects, such as pipe and other workpieces. The apparatus 10 has a jaw 12 and latching member 14 for securing a workpiece therebetween. The latching member 14 may be a chain, as illustrated, or any other type of strap or restraint as is known or later discovered in the art. The purpose of the latching member 14 is to restrain an object within the apparatus 10 once the apparatus 10 is suitably tensioned.

The jaw 12 has an upper surface 16 that is textured (e.g., having teeth) and is generally V-shaped to facilitate securing of the workpiece (not shown). Alternative jaw configurations can be also utilized in accordance with the teachings of the present invention. In particular, the shape of the jaw 12 may be dependent on the shape of the member being held down thereagainst. The jaw 12 is mounted on a stand 18 and interfaces with an outer housing 20. As can be seen in FIG. 1, the stand 18 has a base 22 that supports the apparatus 10 in a vertical orientation. The base 22 may be coupled to a removable base plate 28. The removable base plate 28 can be utilized so as to mount the apparatus 10 (via bolting and bolt holes, for example) to an external surface, such as a workbench, a vehicle, and so forth.

In the embodiment of the present invention, as shown in FIG. 1, the apparatus 10 has its stand 18 coupled to a wing nut 24. This wing nut 24 is in the form of a coupler which serves to interconnect the outer housing 20 the stand 18. The coupling between the outer housing 20 and the stand 18 occurs by the threads 26 on the stand 18 coupled to mating threads 30 on the coupler 24, or any other like manner. The coupler 24 has at least one arm 32 to facilitate rotation of the wing nut 24 about the stand 18. The coupler 24 couples to the outer housing 20. A snap ring 34 is disposed within snap ring grooves 36 and 38 so as to facilitate the connection between the coupler 24 and outer housing 20. The snap ring 34 is disposed within snap ring grooves 36 and 38. The outer housing 20 is illustrated as having an increased inner diameter above groove 34. Consequently, an annular space 44 is defined between the outer housing 20 and stand 18. A socket wall 46 of jaw 12 fits partially and slidably between the outer housing 20 and the stand 18 so as to partially fill annular space 44.

In the embodiment shown in FIG. 1, there is a fixed latching member mount 48 having a recess 50 (as illustrated in dotted lines) on the outer housing 20. This fixed latching member mount 48 is provided to couple the latching member 14 to the outer housing 20. A mounting link 52 of the latching member 14 is inserted in the recess 50 of the fixed latching member mount 48 and secured by latching member mounting pin 54. The jaw 12 is rotationally coupled to the stand 18 via jaw positioning splines 58. These jaw positioning splines 58 interact with the splines 60 on the stand 18. As a result, the outer housing 20 is rotationally coupled to the stand 18. Moreover, in certain examples, this rotation is automatically locked in place in the chosen position when the system is energized.

In FIG. 1, it can be seen that the coupler 24 is turned about the stand 18 so as to cause the coupler to move downwardly in relation to the stand 18. The downward movement of the coupler 24 pulls the outer housing 20 downwardly. The downward movement of the outer housing 20 pulls the latching member 14 also downwardly. The pipe is secured between the jaw 12 and the latching member 14. The snap ring 34 locks into place against the bottom portion of the snap ring groove 38 as the outer housing 20 is pulled downwardly. This serves to effect the locking down of the snap ring 34 and to prevent further rotation of the outer housing 20.

As can be seen, the latching member 14 has a mounted end and a free end. The latching member 14 typically includes standard links. As can be seen, the mounting link 52 mates with a latching member mount wing 48 of the outer housing 20. The end opposite the mounting link 52 is the "free end". At this end, a standard link 59 of the latching member 14 may be releasably (i.e. temporarily) mounted in a latching member latch wing 49 of the outer housing 20.

In operation, apparatus 10 distributes the force relatively evenly on the latching member 14. Thus, there is generally no single contact point of the latching member 14 that receives a large percentage of the exerted force. This reduces the chance of latching member failure and serves to extend the life of the latching member 14.

In operation, an object can be placed upon the upper surface 16 of the jaw 12. The latching member 14 is then latched at the latching member latch wing 49 and then secured around the object. Optionally, prior to engaging the coupler 24, the jaw 12 may be rotated via companion splines if desired. The coupler 24 is turned so as to lower the latching member 14 (via pulling down the outer housing 20) in order to secure the object between the latching member 14 and the jaw 12. If needed, the arm 32 may be tapped with a tool, such as a hammer, to further tighten the latching member over the object. As such, the object may then be processed by cutting, threading, and so forth. Upon completion of processing, it may be desired to remove the object. To release the object, the coupler 24 is turned in the opposite direction to push up the latching member 14. The latching member 14 may be unlatched, if needed.

Figure 2:
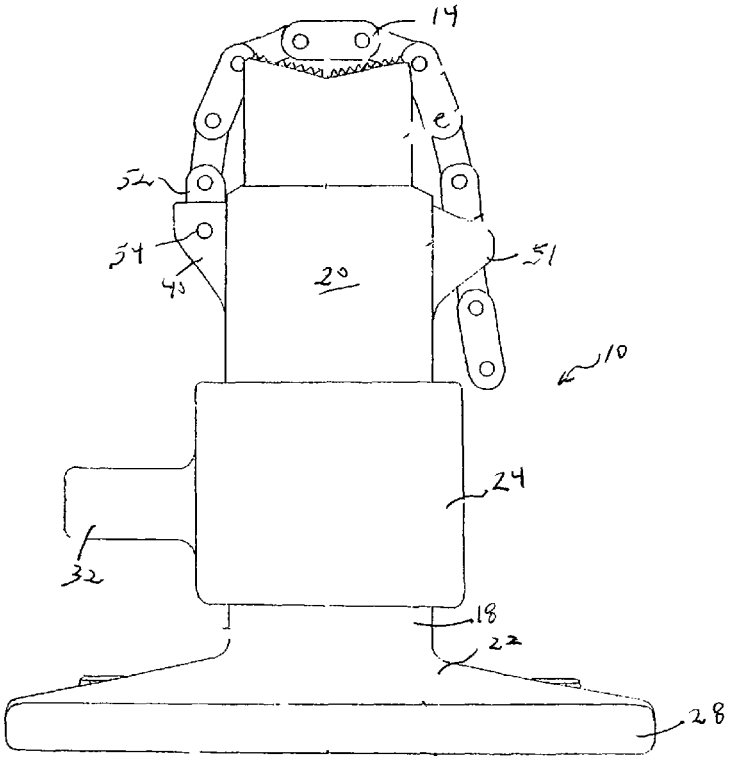
FIG. 2 is a side elevational view of the apparatus for securing objects of the preferred embodiment of the present invention.

FIG. 2 is a side elevational view of the apparatus 10. The base 22 of the stand 18 and base mounting plate 28 are shown. The coupler 24 (in the form of a wing nut) has an arm 32 extending outwardly therefrom. It can be seen that the coupler 24 entirely closes the threaded portions. As such, the present invention effectively prevents any debris from adversely affecting the threaded relationship between the coupler 24 and the threads 26.

The outer housing 20 is illustrated as extending upwardly from the coupler 24. The outer housing 20 has a first outer wing extension 40 on one side thereof and second outer wing extension 51 on an opposite side thereof. The pin 54 is illustrated as secured to a link 52 of the latching member 14. Similarly, another link, on the opposite side of the outer housing 20, has the link latched to the latch 49.

Figure 3:
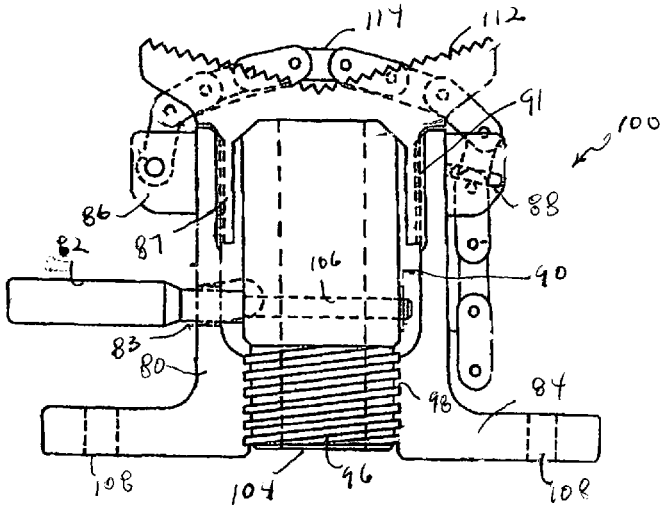
FIG. 3 is a cross-sectional view of a first alternative embodiment of the apparatus for securing objects of the present invention.

FIG. 3 shows an alternative embodiment of the apparatus 100 of the present invention. The apparatus 100 is an alternative form that can be used for the securing of objects therein. In particular, the apparatus 100 has a jaw 112, a latching member 114, a stand 80 and a tensioner pin 82. The stand 80 has a base 84 which may be coupled to a surface. The stand 80 has a mount wing 86 and latch wing 88 so as to facilitate the coupling of the latching member 114 to the stand 80. As can be seen in FIG. 3, the apparatus 100 includes a tensioner sleeve 90. The jaw 112 has an annular member 87 extending downwardly therefrom. This annular member 87 has splines extending vertically in spaced relationship therearound. The stand 80 includes interiorly extending splines 91 which serve to engage with the splines on the annular member 87 of the jaw 112. The splines couple the stand 80 and the jaw 112. The tensioner sleeve 90 has direct contact with the jaw 112.

In FIG. 3, it can be seen that the tensioner pin 82 extends into the tensioner pin port 83 and has a graduated engagement toward the tensioner sleeve 90. The tensioner sleeve 90 has external threads 96 that mate with internal threads 98 of the base 84 of the stand 80. It should be noted that the tensioner sleeve 90 may have an internal bore cavity 104. A cotter pin 106 can be utilized to secure the tensioner pin 82 within the tensioner pin port 83.

The base 84 of stand 80 can have bolt holes 108 for receiving a fastener, such as a bolt, for securing the apparatus 100 to an underlying surface. A lubrication injection point can be provided adjacent to the stand 80 under the latching member 114 and under the jaw 112. The injection point can be made accessible by lifting the latching member 114 and the jaw 112. Beneficially, lubricant (e.g. oil, grease, etc.) can be fed into the lubrication injection point to lubricate internal components of the apparatus 100. The internal distribution of the lubricant may be by gravity, applied pressure, and by similar means.

Figure 4:
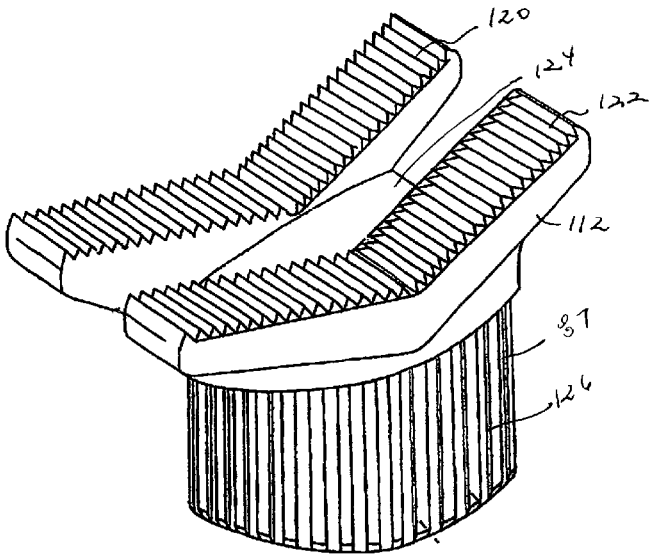
FIG. 4 is a perspective view of the jaw assembly as used in the first alternative embodiment of the present invention of FIG. 3.

FIG. 4 illustrates, in particular, the configuration of the jaw 112. It can be seen that the jaw 112 has a first V-shaped toothed portion 120 and a second V-shaped toothed portion 122. A non-toothed portion 124 is positioned between the toothed portions 120 and 122. As such, the surface associated with the non-toothed portion 124 can serve as an area upon which the latching member 114 can reside. Splines 126 extend vertically in spaced relationship to each other around the diameter of the annular member 87. These splines 126 serve to mate with or engage with the splines on the inner surface of the outer housing. As such, by simply lifting, the jaw 112 can be properly positioned.

Figure 5:
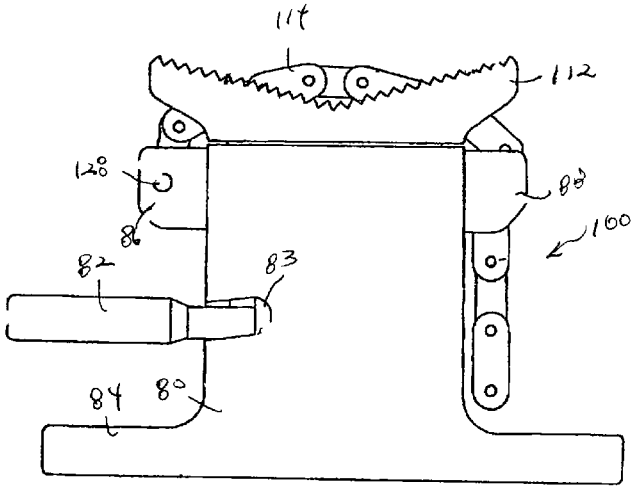
FIG. 5 is a side elevational view of the first alternative embodiment of the apparatus for securing objects of the present invention.

FIG. 5 is a side elevational view of the apparatus 100. In particular, in FIG. 5, it can be seen that the stand 80 has the base 84 arranged for placement on an underlying surface. A port 83 is provided so as to allow the tensioner pin 82 to engage with the tensioner sleeve 90. Mount wing 86 and latch wing 88 are located on opposite sides of the stand 80. It can be seen that a pin 128 engages with the latching member 114 at one end thereof. The latch of the latching wing 88 will engage with a link of the latching member 114 so as to securely maintain the latching member 114 in a desired position. The jaws 112 are of a V-shaped configuration. In FIG. 5, it can be seen that the latching member 114 is positioned in close proximity to the non-toothed surface 124 between the first portion 120 and the second portion 122.

In the operation of the apparatus 100, an object, such as a pipe, is placed on the upper surface of the jaw 112. The latching member 114 is then latched at the latching member latch wing 88 so as to be secured around the object. Then, the tensioner pin 82 is engaged by turning radially or by being pushed or pulled, so as to raise the jaw 112 in order to tighten the latching member 114 over the object against the jaw 112. If need, the tensioner pin 82 may be tapped with a tool, such as a hammer, to further tighten the latching member 114 over the object. After this operation is completed, the object may be processed, such as cut, threaded and so forth. Upon completion of the process. It may be desired to remove the object. To release the object, the tensioner pin 88 is engaged in the opposite direction so as to pull down the jaw 112. As with the operation with the apparatus 10 of the previous embodiment, the latching member 114 may be unlatched, if required.

Figure 6:
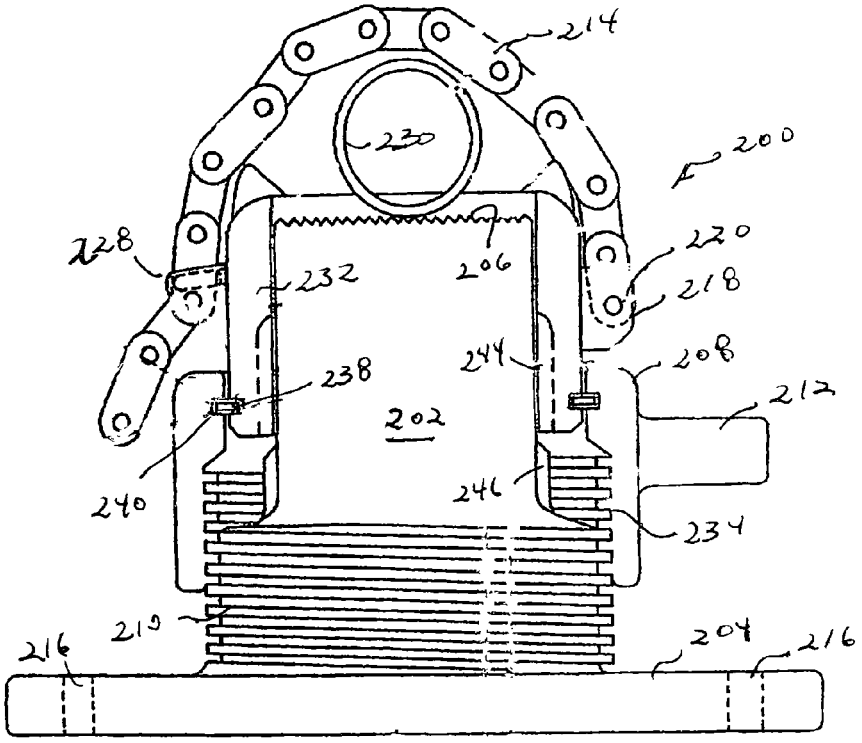
FIG. 6 is a cross-sectional view showing the second alternative embodiment of the apparatus for securing objects of the present invention showing, in particular, an object secured between the latching member and the jaw.

FIG. 6 shows a second alternative embodiment of the apparatus 200 of the present invention. The apparatus 200 includes a latching member 214, a stand 202 and a base 204. The latching member 214 may be of the same, similar, or different than the latching members of the previous embodiments. In the illustration of FIG. 6, the jaw 206 has a flat surface, in contrast to the previous V-shaped jaws. It can be seen that the surface of the jaw 206 is textured. A coupler 208 is connected to the stand 202. The coupling is facilitated by internal threads (not shown) on the coupler 208 which mate with the threads 210 of the stand 202. In addition, as with the embodiment of FIG. 1, the coupler 208 has an arm 212 in order to facilitate rotation of the coupler about the stand 202. The base 204 of the stand 202 can have at least one bolt hole 216 for receiving fasteners in order to secure the apparatus 200 to an underlying surface, if desired. The stand 202 has a latching member mount wing 218 for coupling the latching member 214 (via the latching member mount pin 220) to the stand 202. Additionally, the stand also has a latching member latch wing 228 for releasably coupling the opposite end of the latching member 214 to the stand 202.

In FIG. 6, it can be seen that there is an object 230 that is secured within the apparatus 200. The object 230, or other secured object to be worked or processed, is secured between the latching member 214 and the jaw 206. The free end of the latching member 214 is positioned so that sufficient tension is maintained on the object 230. The free end of the latching member 214 is secured to the latching member latch wing 218. In operation, the apparatus 200 grips the object 230 between the latching member 214 and the jaw 206.

In FIG. 6, the apparatus 200 has an outer housing 232 which is slidably positioned over the stand 202. The inner surface of the outer housing 232 may be generally cylindrical and sized to slidably engage a cylindrical outer surface of the stand 202. The outer housing 232 is constructed to facilitate the ability of the upper portion of stand 202 to pass through the outer housing 232. Suitable guide risers can be disposed adjacent to the latching member 214 near the top of the outer housing 232. These guide risers assist with the guidance and stabilization of the object 230 on the upper surface of the jaw 206.

The stand 202 is coupled to the coupler 208. This coupling is achieved through a threaded connection wherein the stand 202 has threads 210 that mate with the threads 234 of the coupler 208. The coupler 208 is coupled to the outer housing 232 via a snap ring 238 which sits in a snap ring recess 240 on the coupler 208 and in a channel on the outer housing 232. The coupler 208 and the outer housing 232 are vertically coupled but rotationally independent. The stand 202 has external companion keyways 246 that engage internal companion keyways 244 of the outer housing 232. In other words, the internal companion keyway 244 may be formed to slidably receive external companion keyways 246 so as to allow for vertical movement of the outer housing 232.

In the operation of the apparatus 200, an object 230 is placed on the upper surface of the jaw 206. The latching member 214 is then latched at the latching member latch wing 228 and then secured around the object. Optionally, prior to engaging the coupler 208, the jaw 206 may be rotated (gradual or perpetual rotation), if desired. Then, the coupler 208 is turned to lower or pull the latching member 214 down (via the lowering of the outer housing 232) in order to secure the object 230 between the latching member 214 and jaw 206. If needed, the arm 212 may be tapped with a tool, such as a hammer, to further tighten the latching member 214 over the object 230. The jaw 206 generally does not move. Then, the object 230 may be processed, such as cut, threaded, and so forth. Upon completion of processing, it may be desired to remove the object 230. To release the object, the coupler is turned in the opposite direction to push up the outer housing 232 to loosen the latching member 214. The latching member 214 may be unlatched, if required.

Figure 7:
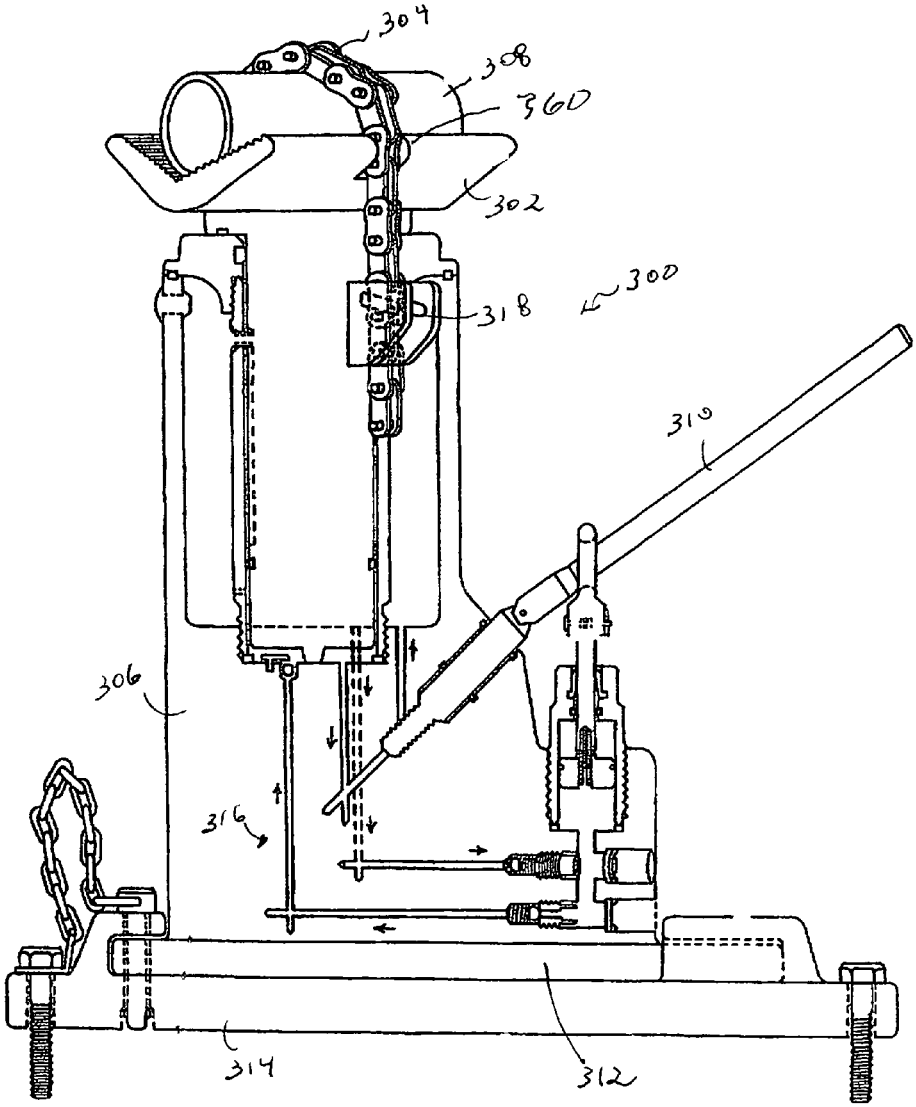
FIG. 7 is a cross-sectional view in partial side elevation which shows a third alternative embodiment of the apparatus for securing objects of the present invention.

FIG. 7 is an illustration of a third alternative embodiment 300 of the present invention. The apparatus 300 utilizes a bottle jack as the means for selectively moving the jaw 302 in relation to the latching member 304. In general, the jaw 302 and the latching member 304 are coupled or mounted on top of the hydraulic jack portion 306. This pushes up on the jaw 302 to secure the object 308 between the jaw 302 and the latching member 304. A handle 310 is used to operate the hydraulic jack portion 306 so as to push the jaw 302 upwardly. In this embodiment, the handle 310 may be turned clockwise and pushed downwardly so as to compress a hydraulic fluid to push up the jaw 302. In order to release the compression, the handle 310 is twisted counter-clockwise. The base 312 of the apparatus 300 may be coupled to a mountable base 314 to facilitate the mounting of the jack portion 306 to an underlying surface. In addition, as should be apparent, the mountable base 314 is removable. In FIG. 7, it can be seen the various inner workings 316 of the hydraulic jack 306. These fluid lines and inner workings are standard arrangements when used in association with such bottle jacks.

In the operation of the apparatus 300, an object 308 is placed on the upper surface of the jaw 302. The latching member 304 is then latched at the latching member latch wing 318 and then secured around the object 308. The handle 310 of the hydraulic jack portion 306 is pushed down so as to compress the hydraulic fluid and push the jaw 302 upwardly so as to secure the object 308 between the latching member 304 and the jaw 302. The latching member 304 does not move significantly. In this position, the object 308 can be processed, such as cut, threaded, and so forth, or simply held in place. Upon completion of processing, it may be desired to remove the object. To release the object, the handle 310 is twisted counter clockwise. The apparatus 300 can be employed as a pipe bender and can also be employed as a bottle jack. For example, if it is desired to utilize the apparatus 300 as a bottle jack, it is only necessary to remove the latching member 304.

In some examples, the apparatus 300 may have a relatively large base plate (mounted horizontally) surface area provided for improved lifting capacity and stability when using the apparatus 300 as a hydraulic jack. The relatively larger base of the jaw 302, which provides the contact securement for the object 308, also produces a V-shaped platform for multi-point contact performance on hydraulic jack lifting surfaces, rather than the traditional smaller, horizontal, flat-grooved limitations of traditional hydraulic bottle jack lifting surface areas. The apparatus 300, with its baseplate 314, is portable and generally produces a weight-reducing improvement versus the use of single hydraulic jack, one hydraulic latching member and a separate hydraulic pipe bender. The apparatus 300 is a three-in-one product and provides a reduced storage volume.

The baseplate 314 provides securement to a stationary placement by means of a plurality of bolt holes in the outer circumference of the baseplate. There is an vertical interlocking cavity that receives the baseplate of the jack. As such, the apparatus 300 can be mounted and locked-in-place by the insertion of a single lock pin into self-aligning upper and lower ports. The apparatus 300 can also have a lock pin that is coupled with lock pin bearings, so as to prevent or reduce loss and removal of the apparatus 300 while in a stationary mounted position, such as on a vehicle bumper, a trailer ball hitch, a work table, and a portable stand.

The jack portion 306 is a cylindrical hydraulic fluid cavity reservoir. It has a cylindrical jaw base, a hydraulic fluid fill plug, applicable seals, vertical engagement drive guide pins, and hydraulic fluid flow lines for entry and exit from the cylindrical hydraulic fluid cavity to the cylindrical jaw base pressurized engagement cavity. Additionally, the jack portion 306 houses the main power piston assembly components to which the handle 300 is attached. There are uni-directional fluid flow check valves which provide corrective flow patterns to the respective hydraulic fluid reservoirs, through machined internal hydraulic fluid flow lines. The jaw base is configured in a generally V-shaped construction with a textured surface for releasably engaging and grasping the securable object while in operation. This textured surface can be in the form of a plurality of teeth. However, within the concept of the present invention, the jaw may be composed of different shapes. The jaw base provides an improved safety-based, enlarged lifting channel wherein omni-directional multiple contact lifting points are available.

The apparatus 300 can include a latching member 304 attachedly fixed at one end to the mount wing 318 without positional adjustment features while arriving substantially perpendicular over and through the jaw base tracks 360 into a length adjustable condition. This movement to a forcibly-engaged locked position when locked engagement is provided to the opposing stationary latching member latch wing. This occurs when hydraulically pressurized through an expansion of the hydraulic fluid volume mass content of the cylindrical jaw base fluid cavity reservoir. The apparatus 300 also provides vertical latching member engagement stress equalization when the latching member is actively grasping a workpiece by the prolonged active pressurized engagement of the cylindrical jaw base toward the pressure-tensioned latching member.

The apparatus 300 creates a substantially uniformly pressurized workpiece at respective contact points. This results in reduced scarring, marring, damage, and shape-altering force to the workpiece 308, as commonly occurs with traditional latching member vises and pipe benders. In addition, when lifting objects while the latching member 304 is attached securely around and enclosing the entire circumference of the lifted object, such as a circular vehicle axle, the apparatus 300 reduces the potentially dangerous practice of the jaw base surface contact area releasing from the lifted object and falling onto the operator and any surrounding material.

When the apparatus 300 is engaged, the pressurized latching member based-force is substantially equalized between the latching member mount wing and the opposing latching member latch wing. This eliminates, or significantly reduces, all of the engagement force that is provided by a singular point of pressurization with standard latching member vises. This prolongs the service life, and reduces dangerous and costly breakages of the latching member. It also creates a consistent, compounded force leverage of the secured object over the entire contact surface area of the latching member, the jaw base and the outer circumference of the secured object. This equalized hydraulic force creates a relatively strong grasping with the latching member. The apparatus 300 will typically reduce corroded and frozen parts commonly found on existing chain vises. This is because the present invention does not openly expose the interior construction. The hydraulic mechanism of the apparatus 300 is entirely closed and automatic and substantially constantly lubricated due to consistent external cylindrical coverage with non-corrosive hydraulic fluids. As such, this produces improvement in reliability and effective uses.

Typically, with prior chain vises, the vise roller guide bearings, the assembly pins, the worm gear latching member actuation and all motion induced components are of an open structure configuration. As such, they can be exposed harmfully to destructive environmental and usage elements. This results in rapid corrosion and results in premature failures. The chain vises of the prior art include a section of links that are encompassed within the constructed track housing in close proximity to the operation handle. It is thereby attached to the operation handle by the worm gear assembly. This worm gear assembly can contain foreign debris and corrosive material. As such, this can lead to the failure of chain vises of the prior art. When the latching members of the chain vises of the prior art corrode, smooth functioning of the vise is prevented. Since the latching member has to travel within the track, fore and aft, while in a restrictive, curved state, smooth functioning will be nearly impossible. The addition of lubrication fluids does not provide an adequate solution. Any additional lubrication fluid would only further attract and retain harmful foreign debris.

As can be seen in FIG. 7, when the apparatus 300 is actually operated, the enlarged V-shaped jaw 302 performs a protective coverage feature relative to the seal and the external surface area of the jaw base cylinder, when in the retracted operational position. The jaw 302 acts an "umbrella" so as to protect any debris from moving downwardly and moving into the sealing area between the piston and the outer housing.

The single-handled operation of the apparatus 300 provides a platform that is easier for upper extremity handicapped individuals to operate. The handle 300 is longer than existing handles used with bottle jacks. As such, the handle 310 produces increased leverage for operation of power piston assembly. As such, physically-handicapped users will find the apparatus 300 to be more easily accessible, and user friendly.

Emergency repair service times may be significantly reduced by the use of the apparatus 300. The financial procurement and worldwide commercial market of the consumer can be significantly improved due to a lower cost associated with manufacturing this three-in-one product. This is achieved while providing the consumer with additional value with added safety and usage features.

Figure 8:
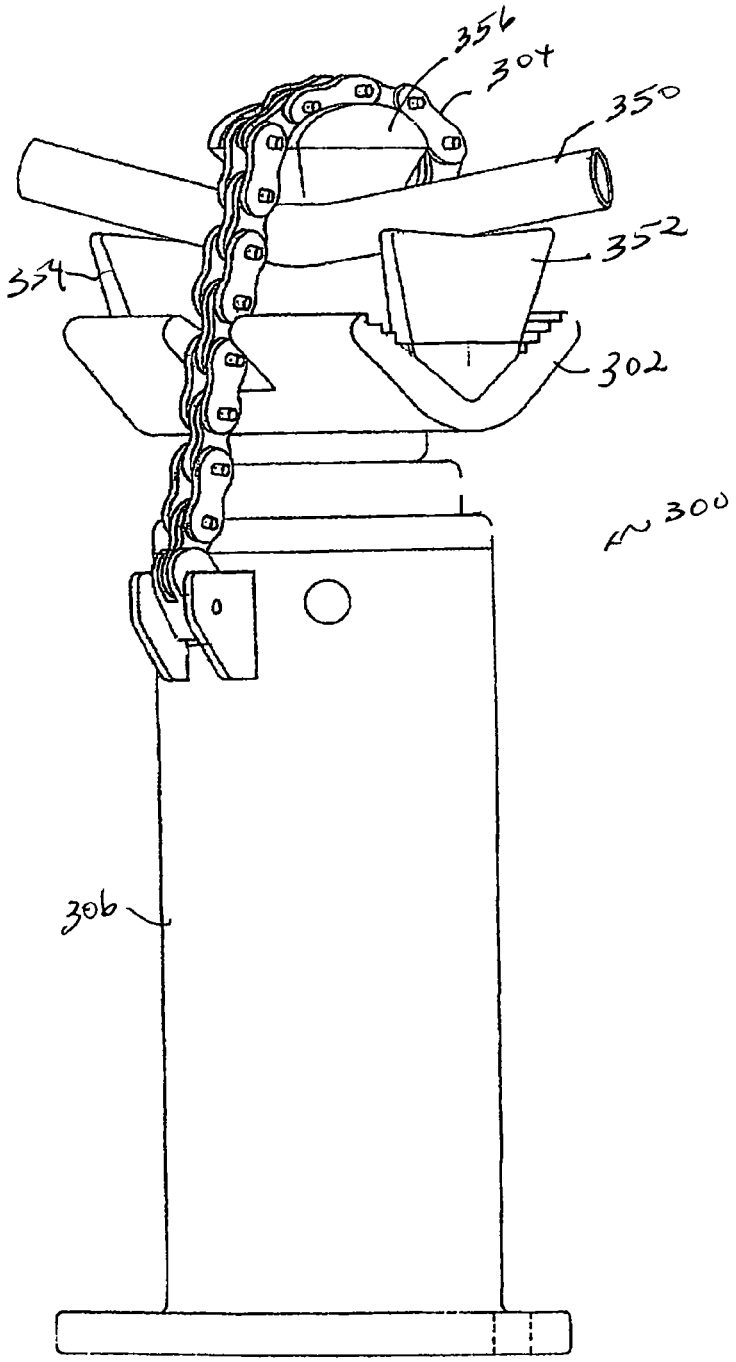
FIG. 8 is a side elevational view showing the apparatus of present invention as used, in particular, for the bending of pipe.

FIG. 8 shows the apparatus 300 as used in association with the bending of a pipe 350. It can be seen that the pipe 350 is supported upon bending plates 352 and 354. Bending plates 352 and 354 are positioned within the channel of the V-shaped jaw 302. As such, there is an open space between the bending plates 352 and 354.

The latching member 304 extends over the top of the pipe 350. Importantly, there is a die 356 which is affixed to the inner surface of the latching member 304. The die 356 will bear upon the surface of the pipe 350 positioned between the bending plates 352 and 354. As an upper force is applied by the operation of the hydraulics of the hydraulic jack portion 306, the bending plates 352 and 354 will urge the ends of the pipe 350 upwardly while the die 356 will urge the center of the pipe downwardly. As such, a desired bend will occur.

The apparatus 300 typically includes a secondary baseplate for secondary mounting applications. As such, it provides a larger diameter platform to support the overall lift capacity of the apparatus 300. This facilitates the ability to use the apparatus 300 of the present invention on soft ground formations, high heat-retaining softened asphalts, brittle concrete flooring, and unstable gravel-based ground materials. As such, the present invention can adequately operate despite the lack of adequate support by the underlying surface.

The various embodiments of the present invention distribute the force evenly on the latching member. Thus, there typically no single contact point of the latching member that receives a large percentage of the exerted force. This reduces the chance of the failure of the latching member and extends the life of the latching member.

The object securing apparatus of the present invention allows a 360° rotation of the jaw at certain positions depending on the spacing of the splines and their arrangements. However, within the concept of the present invention, it may not be necessary to rotate the jaw. In those circumstances in which the jaw can be rotated, it is desirable to position the object on the jaw prior to rotation.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. An apparatus comprising:

an outer housing;

a stand positioned within said outer housing;

a jaw affixed to an upper end of said stand, said jaw having a surface on a top thereof suitable for receiving an object thereon;

a latching member coupled to said outer housing, said latching member extendable over said top of said jaw, said latching member suitable for securely retaining the object against said top of said jaw, said latching member having one end fixedly mounted to one side of said outer housing and an opposite end releaseably connected to an opposite side of said outer housing, said latching member being a chain having a plurality of links, one of said plurality of links engaged by a pin within a mounting wing on said one side of said outer housing, said outer housing having a latch extending outwardly of said opposite side of said housing, another of said plurality of links secured to said latch; and a means for selectively moving said jaw in relation to said latching member.

2. The apparatus of claim 1, further comprising:

a base affixed to a bottom of said stand, said base having a diameter greater than a diameter of said stand.

3. The apparatus of claim 2, said base having a plurality of fasteners secured thereto so as to allow said base to be affixed upon an underlying surface.

4. The apparatus of claim 1, said stand being a cylindrical member extending vertically upwardly, said outer housing having an interior passageway receiving said stand therein.

5. The apparatus of claim 4, said stand having a threaded portion, said means for selectively moving comprising:

a coupler member threadedly engaged with said threaded portion of said stand, said coupler member connected to said outer housing so as to move said outer housing vertically relative to a rotational movement of said coupler member about the threaded portion.

6. The apparatus of claim 5, said coupler member having an arm extending outwardly therefrom.

7. The apparatus of claim 1, said stand having a splined surface at an upper end thereof, said jaw having splines on a surface thereof opposite said top thereof, said splines of said jaw selectively engaging said splined surface of said stand.

8. The apparatus of claim 1, said jaw having a V-shape.

9. The apparatus of claim 8, said jaw having a textured surface.

10. An apparatus comprising:

an outer housing;

a stand positioned within said outer housing;

a jaw affixed to an upper end of said stand, said jaw having a surface on a top thereof suitable for receiving an object thereon;

a latching member couple to said outer housing, said latching member extendable over said top of said jaw, said latching member suitable for securely retaining the object against said top of said jaw, said latching member having one end fixedly mounted to one side of said outer housing and an opposite end releaseably connected to an opposite side of said outer housing, said latching member being a chain having a plurality of links, one of said plurality of links engaged by a pin within a mounting wing on said one side of said outer housing, said outer housing having a latch extending outwardly of said opposite side of said housing, another of said plurality of links secured to said latch; and a means for selectively moving said jaw in relation to said latching member, said stand having a threaded portion extending therearound, said outer housing having a threaded area threadedly engaged with said threaded portion of said stand, said means for selectively moving comprising:

a pin engaged with said stand so as to rotate said pin in relation to said outer housing so as to raise and lower said jaw.

11. The apparatus of claim 10, said outer housing having an inner wall defining an inner passageway, said inner wall having splines extending inwardly therefrom, said jaw having an annular portion extending downwardly therefrom, said annular portion having a splined area selectively received by said splines of said outer housing, said stand extending into said annular portion so as to abut a bottom of said jaw.

12. The apparatus of claim 10, further comprising:

a base formed at a bottom of said outer housing, said base having an outer diameter greater than an outer diameter of said outer housing.

13. The apparatus of claim 1, said stand having a thread formed around an outer surface thereof, said outer housing having an annular member extending around an upper portion of said stand, said annular member having a channel formed therein, said means for selectively moving comprising:

a coupler having an internal thread engaged with said thread of said stand, said coupler having a pin engaged with said channel on said outer housing, said coupler being rotatable about said stand so as to cause said pin to raise or lower said outer housing.

14. The apparatus of claim 13, said coupler having an arm extending outwardly therefrom.

15. The apparatus of claim 1, said jaw being integrally formed at a top of said stand.

16. The apparatus of claim 1, said means for selectively moving comprising:

a bottle jack being hydraulically cooperative with said stand so as to move said stand vertically relative to said outer housing.

17. The apparatus of claim 1, further comprising:

a bending plate received at a top surface of said jaw, said bending plate suitable for receiving the object thereon, said latching member having a die extending inwardly therefrom.

18. An apparatus comprising:

an outer housing;

a stand positioned within said outer housing;

a jaw affixed to an upper end of said stand, said jaw having a surface on a top thereof suitable for receiving an object thereon;

a latching member couple to said outer housing, said latching member extendable over said top of said jaw, said latching member suitable for securely retaining the object against said top of said jaw, said latching member having one end fixedly mounted to one side of said outer housing and an opposite end releaseably connected to an opposite side of said outer housing, said latching member being a chain having a plurality of links, one of said plurality of links engaged by a pin within a mounting wing on said one side of said outer housing, said outer housing having a latch extending outwardly of said opposite side of said housing, another of said plurality of links secured to said latch; and a means for selectively moving said jaw in relation to said latching member, said jaw comprising:

a first V-shaped toothed portion;

a second V-shaped toothed portion; and an untoothed portion positioned between said first V-shaped toothed portion and said second V-shaped toothed portion.

* * * * *